US009280108B2

(12) United States Patent
Sato et al.

(10) Patent No.: US 9,280,108 B2
(45) Date of Patent: Mar. 8, 2016

(54) FIXING DEVICE

(71) Applicant: CANON KABUSHIKI KAISHA, Tokyo (JP)

(72) Inventors: Noriaki Sato, Mishima (JP); Yasutaka Yagi, Mishima (JP); Hiroshi Kataoka, Suntou-gun (JP); Eiji Uekawa, Susono (JP); Keisuke Mochizuki, Suntou-gun (JP); Shuji Saito, Suntou-gun (JP); Naoto Tsuchihashi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/808,428

(22) Filed: Jul. 24, 2015

(65) Prior Publication Data

US 2016/0026131 A1 Jan. 28, 2016

(30) Foreign Application Priority Data

Jul. 28, 2014 (JP) ..... 2014-152891

(51) Int. Cl.
*G03G 15/20* (2006.01)

(52) U.S. Cl.
CPC ..... *G03G 15/2053* (2013.01)

(58) Field of Classification Search
CPC ..... G03G 15/2053; G03G 15/2028; G03G 15/2085; G03G 2215/2003; G03G 2215/2035; G03G 2215/2041
USPC ..... 399/329, 323, 334, 122
See application file for complete search history.

(56) References Cited

U.S. PATENT DOCUMENTS

| | | | | |
|---|---|---|---|---|
| 7,203,438 | B2 | 4/2007 | Omata et al. | |
| 7,215,899 | B2 | 5/2007 | Kimizuka et al. | |
| 7,251,447 | B2 | 7/2007 | Kanamori et al. | |
| 7,512,370 | B2 | 3/2009 | Shimizu et al. | |
| 7,518,089 | B2 | 4/2009 | Hashiguchi et al. | |
| 8,265,538 | B2 * | 9/2012 | Nishinoue | G03G 15/206 399/329 |
| 8,331,819 | B2 | 12/2012 | Fukuzawa et al. | |

(Continued)

FOREIGN PATENT DOCUMENTS

| | | |
|---|---|---|
| JP | 63-313182 | 12/1988 |
| JP | 2-157878 | 6/1990 |

(Continued)

OTHER PUBLICATIONS

U.S. Appl. No. 14/726,895, filed Jun. 1, 2015.

(Continued)

*Primary Examiner* — Billy Lactaoen
(74) *Attorney, Agent, or Firm* — Fitzpatrick, Cella, Harper & Scinto

(57) ABSTRACT

A fixing device includes: a cylindrical film; a nip forming member; and a back-up member for forming a nip. The nip forming member includes a projected portion. The projection amount of the projected portion is smaller in an end portion region positioned at an end portion of the projected portion with respect to a generatrix direction of the film than in a central region positioned at a central portion of the projected portion with respect to the generatrix direction, at least a part of the end portion region being inside a feeding region of a maximum-sized recording material usable in the fixing device. With respect to the recording material feeding direction, the width of the part of the projected portion inside the nip is broader in the end portion region than in the central region.

8 Claims, 12 Drawing Sheets

(56) References Cited

U.S. PATENT DOCUMENTS

| | | | | |
|---|---|---|---|---|
| 8,483,603 | B2 | 7/2013 | Nihonyanagi et al. | |
| 8,526,870 | B2 * | 9/2013 | Shinshi | G03G 15/2053 399/328 |
| 8,606,164 | B2 | 12/2013 | Uekawa et al. | |
| 8,725,020 | B2 | 5/2014 | Fukuzawa et al. | |
| 8,744,296 | B2 | 6/2014 | Fukuzawa et al. | |
| 8,918,001 | B2 | 12/2014 | Kurata et al. | |
| 9,002,249 | B2 | 4/2015 | Uekawa et al. | |
| 9,091,977 | B2 | 7/2015 | Saito et al. | |
| 2013/0322936 | A1 * | 12/2013 | Yagi | G03G 15/2021 399/329 |
| 2014/0153982 | A1 * | 6/2014 | Adachi | G03G 15/2028 399/329 |
| 2014/0161498 | A1 | 6/2014 | Hashiguchi et al. | |
| 2014/0161500 | A1 | 6/2014 | Kataoka et al. | |
| 2015/0132020 | A1 | 5/2015 | Saito et al. | |

FOREIGN PATENT DOCUMENTS

| | | | |
|---|---|---|---|
| JP | 2003-282230 | | 10/2003 |
| JP | 2008225021 A | * | 9/2008 |
| JP | 2011-033671 | | 2/2011 |

OTHER PUBLICATIONS

U.S. Appl. No. 14/733,283, filed Jun. 8, 2015.

* cited by examiner

FIXING DEVICE

FIELD OF THE INVENTION AND RELATED ART

The present invention relates to a fixing device in an image forming apparatus such as a copying machine, a printer or a facsimile machine.

The image forming apparatus forms an unfixed toner image corresponding to image information on a surface of a recording material (such as paper, printing paper, a transfer material sheet, an OHP sheet, glossy paper or glossy film) in a direct (transfer) system or an indirect (transfer) system by an image forming process such as electrophotography, electrostatic recording or magnetic recording. Then, the image is fixed as a fixed image on the surface of the recording material by the fixing device.

As the fixing device, a fixing device of a heat-fixing type in which the unfixed toner image formed on the recording material is heated and melted and then is fixed on the recording material is used in general. As the fixing device of this heat-fixing type, a so-called heating-roller fixing device is known, in which the recording material on which the unfixed toner image is placed is passed through a contact nip (fixing nip) between two heating rollers (fixing roller and pressing roller) and then the toner image is melted and fixed on the recording material.

On the other hand, in recent years, a fixing device using a fixing belt (fixing film) having a small thermal capacity is used (Japanese Laid-Open Patent Application Sho 63-313182 and Japanese Laid-Open Patent Application Hei 2-157878). In this fixing device, the warm-up time is short, and therefore a FPOT (first print out time: a time until a first recording material is discharged) is also short. In addition, there is no need to maintain a preheating state at high temperature during stand-by, and therefore the fixing device is excellent in energy-saving performance.

In the fixing device using such a fixing belt, the fixing belt is heated by being supplied with heat from a heating source such as a heater, but the fixing belt itself is caused to generate heat by being supplied with energy, other than heat, through induction heating and so on in some cases. Further, the fixing device includes a pressing mechanism for pressing the fixing belt surface against a pressing member such as a pressing roller to form a fixing nip as a close contact region between the fixing belt and the pressing member, and the recording material on which the unfixed toner image is placed is passed through this fixing nip, so that the toner image on the recording material is fixed.

With respect to this pressing mechanism, as shown in FIG. 11, as a nip forming member (supporting member) for pressing a fixing belt 130 toward a pressing roller 201, in addition to a heater 131, a guiding member 132 also functioning as a guide for the fixing belt 130 is provided inside the fixing belt 130. The guiding member 132 supports the heater 131. Further, a constitution, as shown in (a) of FIG. 12, is known in which in a region of a fixing nip 101, a projected portion 700 projected toward the pressing roller 201 is provided in a downstream side of a recording material feeding direction.

That is, in the case where the projected portion 700, projected toward the pressing roller 201 more than the surface of the heater 131 is provided, at a position thereof, the fixing belt 130 can be pressed toward the pressing roller 201 with a locally high pressure. In (b) of FIG. 12, the distribution of a pressure per unit area corresponding to each of the positions in a region of the fixing nip 101 is shown as an example.

At the projected portion 700, as a result of such a high pressure, during a fixing process, a toner is satisfactorily deformed to closely contact the recording material, so that the fixing property of the apparatus is improved. Further, the toner is melted and extended, so that the image surface becomes smooth, so that the gloss (glossiness) of the image is improved. Further, by providing such a projected portion in a downstream side of the fixing nip with respect to a recording material feeding direction, the temperature of the toner becomes high by heating, and thus a high pressure can be applied to the toner when the viscosity of the toner is lowered, with the result that an effect of improving the fixing property and the glossiness is further enhanced.

However, in order to obtain the effect of improving the fixing property and the glossiness, in the case where the nip forming member is provided with the projected portion as described above, the separation performance of the recording material from the fixing belt is lowered particularly in the case of the recording material, such as thin paper having a small basis weight. That is, the recording material, such as the thin paper being of a small basis weight, coming out of the fixing nip, is discharged in a side closer to the fixing belt, with the result that a leading end of the recording material abuts against a paper discharging guide for guiding the recording material to a paper discharge portion in some cases. Or, such a phenomenon that the recording material passes through between the paper discharging guide and the fixing belt and winds about the fixing belt occurs in some cases. That is, an improper feeding occurs in which the recording material coming out of the fixing nip cannot be guided to the paper discharge portion generated in some cases.

SUMMARY OF THE INVENTION

According to an aspect of the present invention, there is provided a fixing device for fixing an image on a recording material, comprising: a cylindrical film; a nip forming member contacting an inner surface of the film; and a back-up member for forming a nip in cooperation with the nip forming member via the film. The nip is a contact region where the film and the back-up member contact each other to feed the recording material and is a portion extending from an entrance where the recording material enters the contact region in an unnipped state to an exit where the recording material comes out of the contact region. The nip forming member includes a projected portion, in a neighborhood of the exit, projected toward the back-up member. At least a part of the projected portion with respect to a recording material feeding direction is inside the nip and contacts the inner surface of the film. The projection amount of the projected portion is smaller in an end portion region positioned at an end portion of the projected portion with respect to a generatrix direction of the film than in a central region positioned at a central portion of the projected portion with respect to the generatrix direction. At least a part of the end portion region is inside a feeding region of a maximum-sized recording material usable in the fixing device. With respect to the recording material feeding direction, the width of the part of the projected portion, inside the nip is broader in the end portion region than in the central region.

According to another aspect of the present invention, there is provided a fixing device for fixing an image on a recording material, comprising: a cylindrical film; a nip forming member contacting an inner surface of the film; and a back-up member for forming a nip in cooperation with the nip forming member via the film. The nip is a contact region where the film and the back-up member contact each other to feed the recording material and is a portion extending from an entrance where the recording material enters the contact region in an unnipped state to an exit where the recording material comes out of the contact region. The nip forming member includes a projected portion, in a neighborhood of the exit, projected toward the back-up member. At least a part of the projected portion with respect to a recording material feeding direction is inside the nip and contacts the inner surface of the film, and a feeding region of a maximum-sized recording material usable in the fixing device. The projected portion has a region in which the projection amount gradually decreases from the central portion toward the end portion with respect to the generatrix direction and in which a width of the part of the projected portion inside the nip gradually broadens from the central portion toward with respect to the recording material feeding direction.

These and other objects, features and advantages of the present invention will become more apparent upon a consideration of the following description of the preferred embodiments of the present invention taken in conjunction with the accompanying drawings.

DESCRIPTION OF EMBODIMENTS

Embodiments of the present invention will be described in detail with reference to the drawings.

Embodiment 1

Image Forming Apparatus

Figure 1:
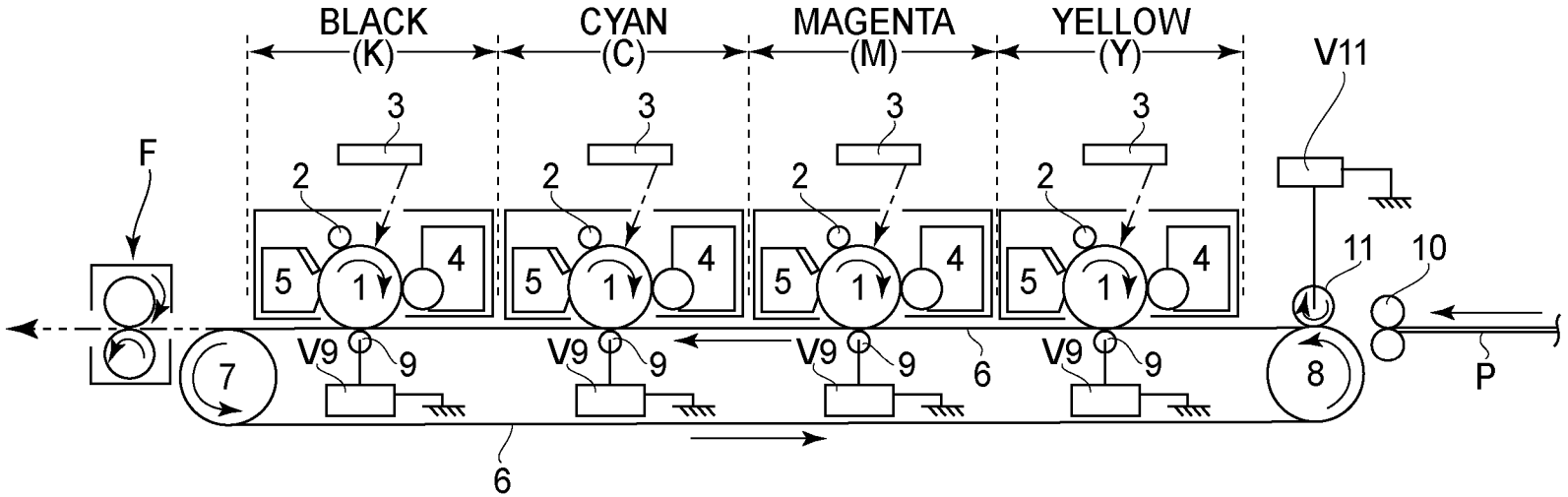
FIG. 1 is a schematic view of an image forming apparatus in which a fixing device according to Embodiment 1 is mounted.

FIG. 1 is a schematic structural view of an image forming apparatus in which a fixing device according to Embodiment 1 is mounted. This image forming apparatus is a color image forming apparatus of an electrophotographic type. In FIG. 1, Y, M, C and K represent first to fourth toner image forming units for yellow, magenta, cyan and black, respectively. Each of the units is constituted by an electrophotographic process mechanism including a rotating drum-type electrophotographic photosensitive member (hereinafter referred to as a photosensitive drum) 1 as an image bearing member, a charging device 2, a laser exposure optical system 3, a developing device 4, a cleaning device 5, and the like.

The photosensitive drum 1 is rotationally driven in an arrow direction at a predetermined peripheral speed, and then a toner image corresponding to each of colors is formed on the surface of the photosensitive drum 1 by a known electrophotographic image forming process.

A transfer belt 6 is extended and stretched between a driving roller 7 and a turn roller 8, and is disposed under the respective units Y to K so as to extend over the units. The transfer belt 6 is rotationally driven in the counterclockwise direction indicated by arrows at a peripheral speed corresponding to the peripheral speed of the photosensitive drum. A transfer roller 9 press-contact the transfer between toward a lower surface of the photosensitive drum 1 in each of the units Y, M, C and K, so that a transfer nip is formed.

A registration roller pair 10 feeds a sheet-like recording material (transfer material, sheet) P, which is one sheet separated and fed from an unshown sheet (paper) feeding mechanism portion, toward an end portion of the transfer belt 6 in the first unit Y at a predetermined control timing. The fed recording material P is electrostatically attracted to the surface of the transfer belt 6 by an electrode roller 11. The transfer belt 6 successively feeds the recording material P to the transfer nips of the first to fourth units Y, M, C and K while holding the recording material P.

In FIG. 1, V11 represents a bias (voltage) applying power source to the electrode roller 11. Further, V9 represents a transfer bias applying power source to each of the transfer rollers 9.

As a result, on the surface of the same recording material P, a yellow toner image, a magenta toner image, a cyan toner image and a black toner image are superposed transferred successively in a positionally aligned state, so that an unfixed full-color toner image is synthetically formed.

The recording material P fed and passed through the transfer nip of the fourth unit K is separated from the transfer belt 6 and then is introduced into a fixing device F, in which the unfixed toner image is heated and fixed on the recording material P, and then the recording material P is fed and discharged as a full-color image-formed product.

(Fixing Device)

Figure 2:
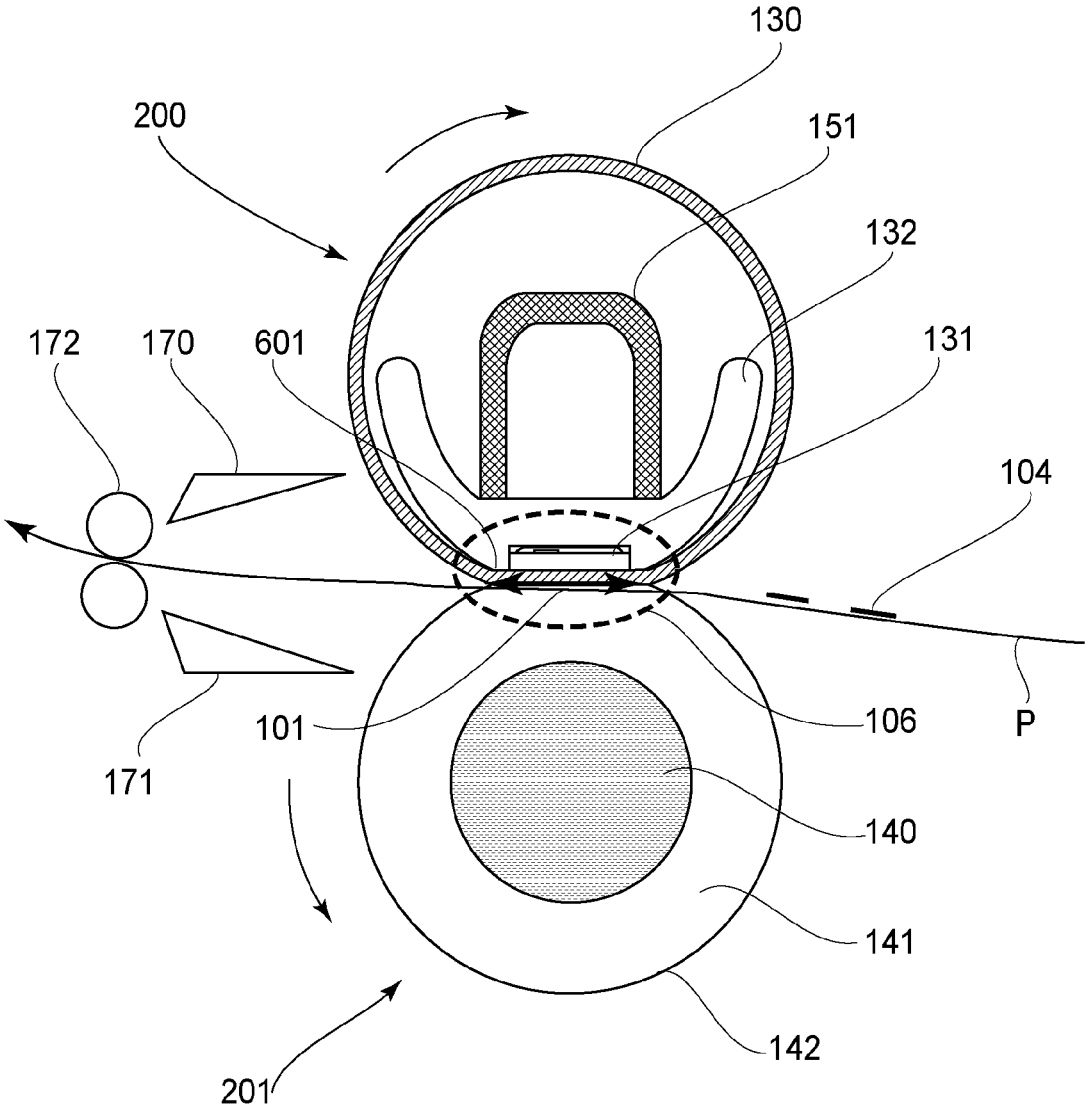
FIG. 2 is a schematic view showing a cross-section of the fixing device in Embodiment 1.

The structure of the fixing device in this embodiment will be described. FIG. 2 illustrates a schematic cross-sectional structure of the fixing device when the fixing device is cut along a flat plane perpendicular to a longitudinal direction (a direction perpendicular to a recording material feeding direction). In FIG. 2, a heating unit 200 includes a fixing belt 130, which is a hollow rotatable member (first rotatable member) to be heated, and a plate-like heater 131 for heating the fixing belt 130. The heater 131 is contacted to an inside (inner surface) of the fixing belt 130, so that the fixing belt 130 is heated.

A pressing roller 201 as a pressing member (back-up member) contacts the surface of the fixing belt 130. The fixing belt 130 is prepared by forming a 200 μm-thick silicone rubber layer as an elastic layer on a cylindrical base layer, which is formed of a polyimide resin material and which is 60 μm in thickness, 18 mm in inner diameter and 235 mm in length and then by coating an outer surface of the elastic layer with a parting layer formed with a 30 μm-thick PFA resin tube.

As the base layer of the fixing belt 130, it is also possible to use another heat-resistant resin material or a metal material such as nicked or SUS (stainless steel). Further, the parting layer can also be formed by coating the elastic layer with a fluorine-containing resin material or the like. The elastic layer can also be omitted, but particularly as in this embodiment, in the case of the fixing device used in the color image forming apparatus, it is desirable that the elastic layer is not omitted in order to prevent uneven glossiness of an output image.

The reason why the toner of the elastic layer of the fixing belt described above is set at 200 μm is as follows. That is, by thickening the elastic layer, the effect of prevention of uneven glossiness of an image caused due to surface unevenness of the recording material P is enhanced, but on the other hand, the degree of heat conduction from the heater 131 to the belt surface decreases, so that the thermal capacity of the belt itself further increases, and therefore the temperature rise time of the fixing belt becomes slow.

According to a study by the present inventors, a good balance between the uneven glossiness and the temperature rise time was obtained when the thickness of the elastic layer is about 50-1000 μm, preferably about 100-500 μm. At this time, the thermal capacity (per $cm^2$) of the fixing belt was about $4.19\times10^{-2}$ J/$cm^2$·K-$4.19\times10^{2}$ J/$cm^2$·K.

Further, an increase in thermal conductivity is also effective in shortening the temperature rise time of the fixing belt 130 and improving the fixing performance of the fixing belt 130. Therefore in this embodiment, as the silicone rubber for the elastic layer, a silicone rubber having a high heat conductivity of 1.0 W/m·K or more was used.

The heater 131 is prepared by forming a heat generating resistor on a substrate which is molded with ceramic such as alumina or aluminum nitride in a size of 270 mm in length, 7 mm in width and 0.7 mm in thickness. In this embodiment, the heat generating resistor was formed by printing on a surface, of the surface of the heater 131, opposite from a surface contacting the fixing belt 130, and thereon, an 80 μm-thick protective layer formed of glass was provided. On the substrate surface contacting the fixing belt, a 10 μm-thick protective layer formed of glass having a smooth surface is provided in order to prevent abrasion of the substrate and the fixing belt while maintaining the sliding property with the fixing belt.

In order to control the temperature of the heater 131, a thermistor (not shown) is provided in contact with the heater 131 at the heater surface opposite from the surface contacting the fixing belt. A heat generation amount (supplied electric power) is controlled so that the temperature detected by the thermistor reaches a target temperature. The thermistor is disposed at each of a longitudinal central portion and longitudinal two end portions. The temperature control is principally made using a main thermistor provided at the longitudinal central portion.

In FIG. 2, a guiding member (supporting member, nip forming member) 132 is formed of a heat-resistant resin material (liquid polymer or the like) and presses the fixing belt against the pressing roller and also performs the functions of not only holding the heater 131, but also guiding travelling of the fixing belt 130 at a curved portion.

A metal framework 151 performs the function of supporting (press-contacting) the guiding member 132 over the longitudinal direction. A pressure of 196 N in total applied to the metal framework 151 by a pressing mechanism (not shown) is transmitted to the guiding member 132. As a result, the fixing belt 130 is press-contacted to the pressing roller 201 by both of the guiding member 132 and the heater 131 held by the guiding member 132. In this way, the guiding member 132 and the heater 131 function as the supporting member (nip forming member) for supporting the fixing belt from the back surface (side) to press the fixing belt toward the pressing roller.

As the pressing roller 201, a roller was used that was prepared by providing a 4 mm-thick elastic layer 141 formed with a silicone rubber on a stainless metal core 140 of 14 mm in outer diameter and then by providing thereon, as a parting layer, a 50 μm-thick surface layer 142 formed of a PFA resin material. Therefore, the outer diameter of the pressing roller 201 is about 22 mm. The product hardness of the pressing roller 201 was 55 degrees (ASKER-C hardness, load: 1.0 kg). The width (length with respect to the recording material feeding direction) of the fixing nip 101, which is a contact region between the fixing belt 130 and the pressing roller 201, is formed by deformation of the elastic layer 141 under application of the pressure from the ceramic heater 131.

The pressing roller 201 is driven by a driving motor (not shown). The fixing belt 130 is rotated by the pressing roller 201 by a frictional force acting at the fixing nip 101, and is rotationally driven in an arrow direction (clockwise direction) at the same speed as that of the pressing roller 201 while press-contacting and sliding with the heater 131 and the guiding member 132.

At this time, in order to reduce the frictional force generated between the fixing belt and the guiding member, heat-resistant grease as a lubricant is interposed between these members. As the heat-resistant grease, e.g., a mixture of a fluorine-containing oil and a fluorine-containing resin material can be used. In this embodiment, as the lubricant, grease ("HP-300", manufactured by Dow Corning Toray Co., Ltd.) was used in an amount of 400 mg.

During normal image formation in which the image is formed on plain paper or the like having a basis weight of 60-100 g/$m^2$, not only the pressing roller 201 is driven at a peripheral speed of 200 mm/sec, but also electric power is supplied to the heater so that the surface temperature of the fixing belt increases up to a fixable temperature of 180° C. or more.

Then, when the transfer process is ended, the recording material P on which an unfixed toner image 104 is placed is guided into the nip and is nipped and fed, and by pressure applied at the fixing nip and heat conducted from the fixing belt and the heater, the toner is melted and fixed on the recording material.

Thus, the fixing process is completed, and then the recording material discharged from the fixing nip is guided into a sheet (paper) discharging roller pair 172 an upper sheet discharging guide 170 and a lower sheet discharging guide 171, which are guiding members for discharging the recording material to a sheet discharge portion, and thus the recording material is discharged to an outside of the fixing device and the image forming apparatus.

(Projected Portion of Nip Forming Member)

Figure 3:
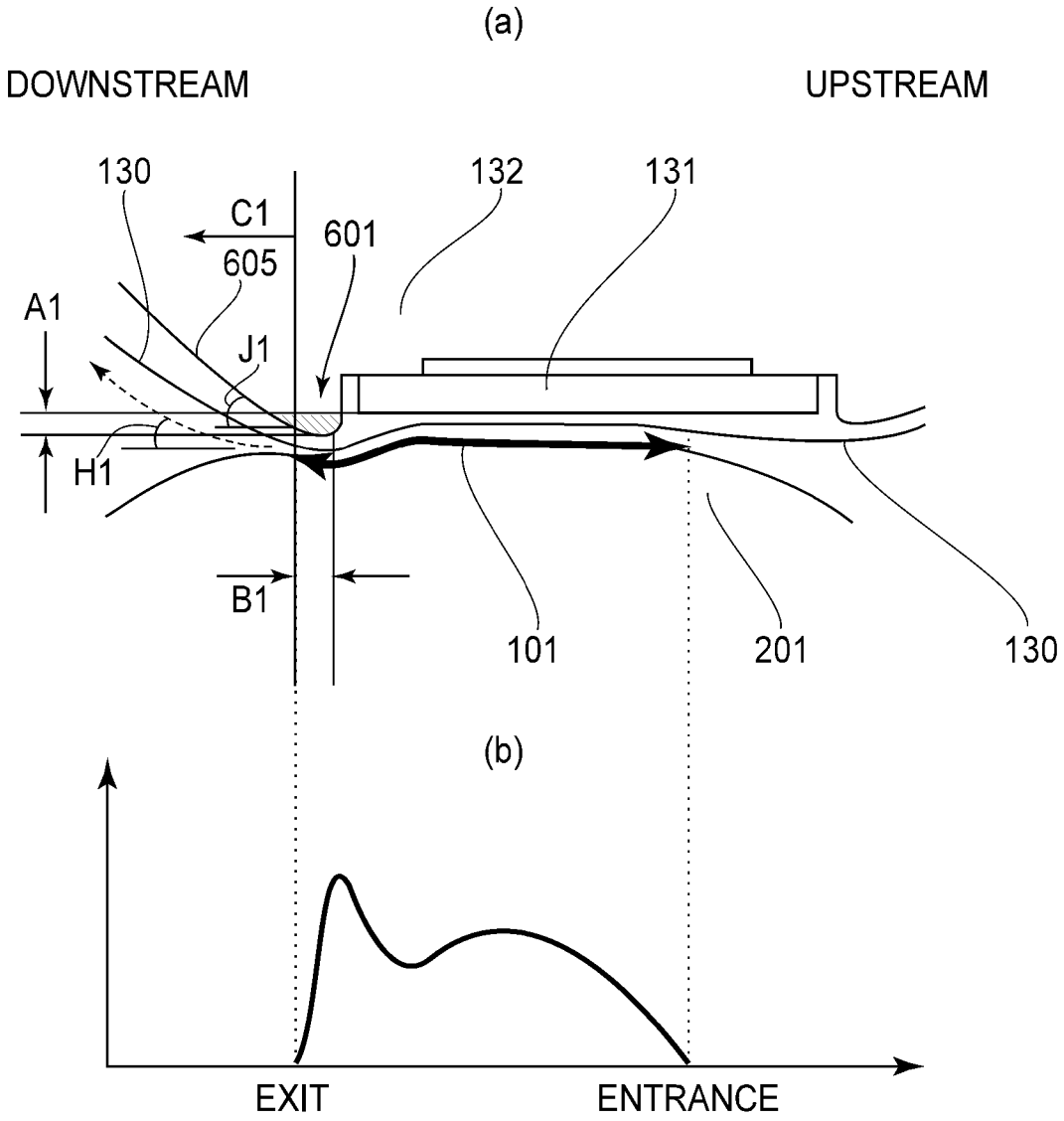
In FIG. 3, (a) and (b) are views each in the neighborhood of a fixing nip in a central region of the fixing device in Embodiment 1.
Figure 4:
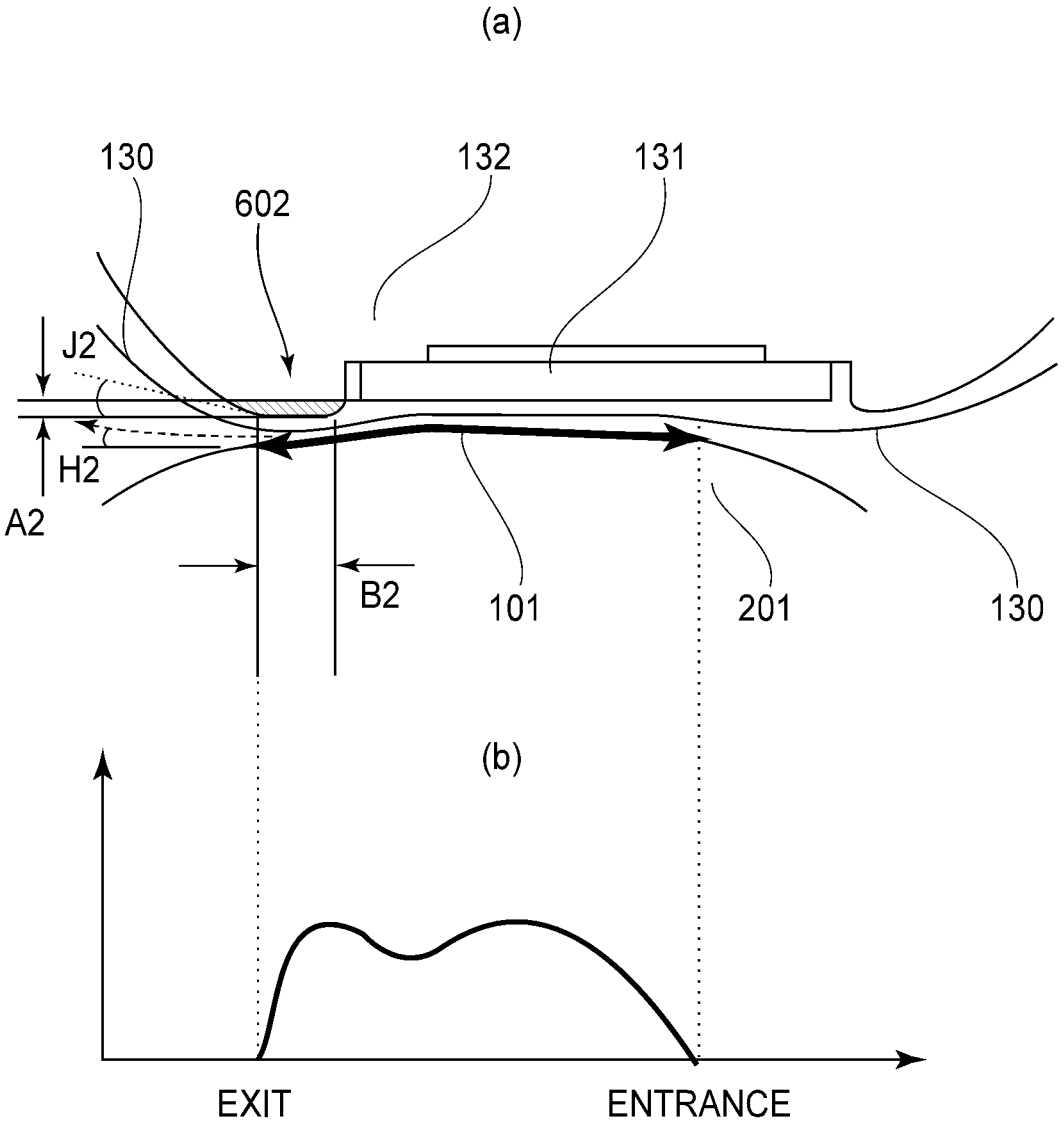
In FIG. 4, (a) and (b) are views each in the neighborhood of the fixing nip in an end portion region of the fixing device in Embodiment 1.

The nip forming member and the projected portion thereof in this embodiment will be described. In FIG. 3, (a) is an enlarged sectional view of a portion in the neighborhood of the fixing nip 101 enclosed by an elliptical broken line 106 in FIG. 2 showing the fixing device in this embodiment, in which a cross-section at a longitudinal central portion is shown (a cross-section at a longitudinal end portion is shown in FIG. 4).

Here, with respect to the projected portion of the nip forming member, the longitudinal central portion means, as described hereinafter, a region in the neighborhood of a center position of a longitudinal effective region where the recording material passes. Also, the longitudinal end portion in each of both sides means a region in the neighborhood of each of longitudinal end portions where the recording material passes. Details thereof will be described later.

Figure 11:
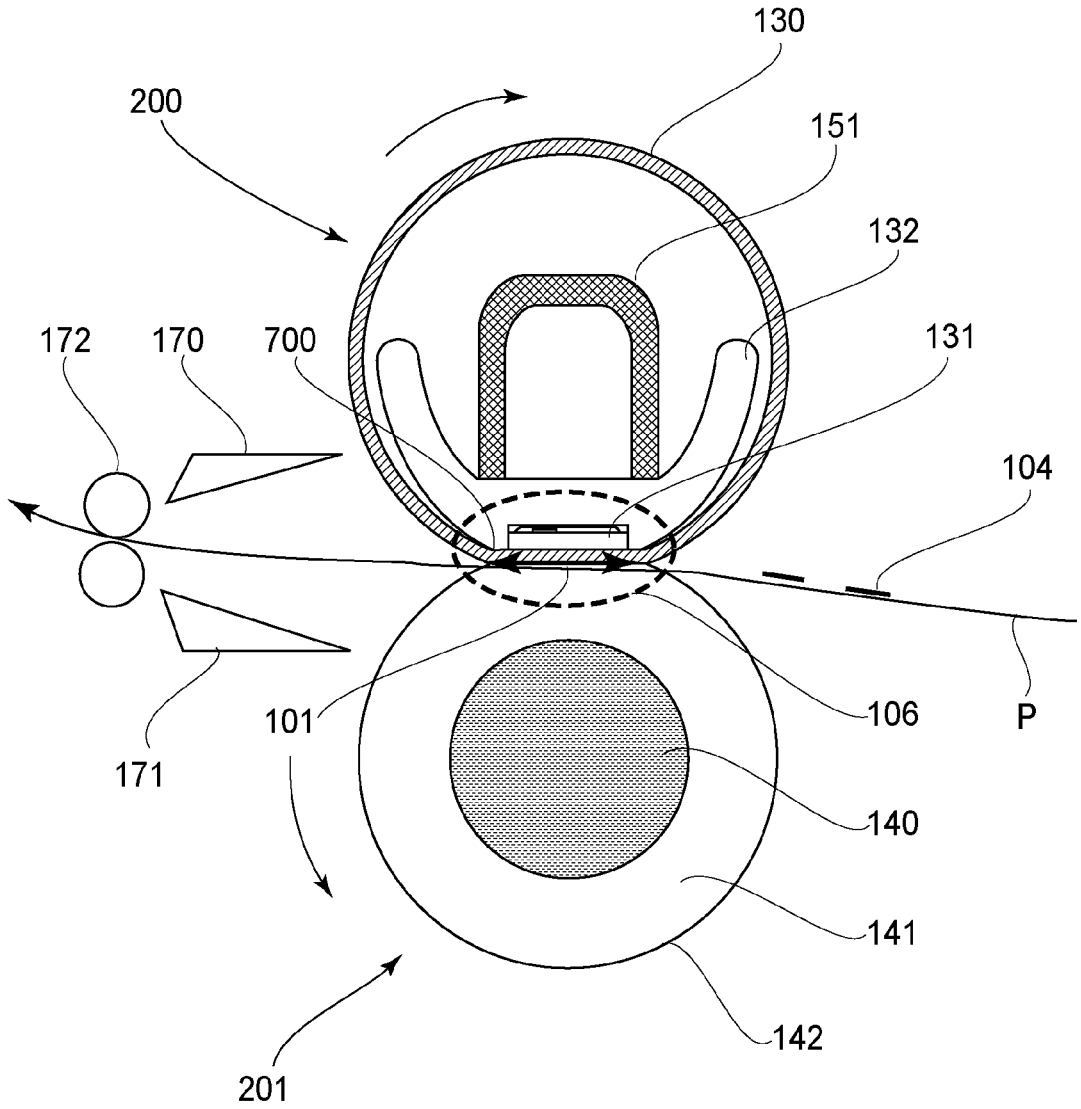
FIG. 11 is an enlarged sectional view showing the neighborhood of a fixing nip in a fixing device according to a conventional example.

In this embodiment, at the longitudinal central portion, the nip forming member has the same cross-sectional shape as that of a conventional example shown in FIG. 11. Further, in (b) of FIG. 3, similarly as in (b) of FIG. 11, a pressure distribution corresponding to each of the positions is shown.

In this embodiment, the heater 131 and the guiding member 132, as the nip forming member, contact the inner surface of the fixing belt 130, so that the fixing belt 130 is closely contacted to the pressing roller 201. That is, the nip forming member forms the fixing nip 101 in cooperation with the pressing roller 201 via the fixing belt 130. The fixing nip 101 referred to herein is a contact region where the fixing belt 130 and the pressing roller 201 contact each other and the recording material is fed, and is a portion from an entrance, where the recording material in a state in which the recording material is not nipped in the contact region enters the contact region, to an exit where the recording material comes out of the contact region.

At a central portion in the region of the fixing nip 101 with respect to the recording material feeding direction, the heater 131 functions as the nip forming member and contacts the inner surface of the fixing belt 130, and thus forms the fixing nip 101 in cooperation with the pressing roller 201. In a downstream region of the region of the fixing nip 101 with respect to the recording material feeding direction, the guiding member 132 function so as the nip forming member and contacts the inner surface of the fixing belt 130, and thus forms the fixing nip 101 in cooperation with the pressing roller 201.

In this embodiment, the guiding member 132 is provided with projected portions 601 and 602. That is, in the downstream side in the fixing nip with respect to the recording material feeding direction, the projected portion projecting in a direction approaching the pressing roller 201 is provided. Such a projected portion is provided over the longitudinal direction. In a longitudinal central portion region (central region) of the guiding member 132, the projected portion 601 shown in FIG. 3 is provided. In a longitudinal end portion region of the guiding member 132, the projected portion 602 shown in FIG. 4 is provided.

The projected portions 601 and 602 are continuously formed with respect to the longitudinal direction.

The projection amount of the projected portion 601 in the central region is defined as follows. The projection amount is an amount (A1 in FIG. 3) in which a top (point) of the projected portion 601 projects from the surface (flat portion) of the heater 131 positioned at the central portion in the fixing nip 101 with respect to the recording material feeding direction toward the pressing roller 201. In this embodiment, the heater 131 is disposed on a flat plane perpendicular to a pressing direction (i.e., a downward direction in the figure), and therefore the amount by which the projected portion 601 simply projects from the surface of the heater 131 is the projection amount.

Of the projected portion 601, a region where the projected portion forms the fixing nip in cooperation with the pressing roller 201 via the fixing belt 130 is called a peak pressure forming region, and the width (B1 in FIG. 3) of the peak pressure forming region with respect to the recording material feeding direction is called a peak pressure forming width. The peak pressure forming region is a region contained in the region of the fixing nip 101. In a region (C1 in FIG. 3) further downstream of the peak pressure forming region in the guiding member 132, an inclined portion 605 having such a shape that the guiding member 132 is gradually spaced from the pressing roller 201 is provided.

FIG. 4 is a sectional view of the fixing device in the longitudinal end portion in this embodiment. Also, with respect to the projected portion 602 in the longitudinal end portion, similarly as in the case of the projected portion 601, the projection amount is an amount (A2 in FIG. 4) in which a top (point) of the projected portion 602 projects from the surface of the heater 131 toward the pressing roller 201.

Further, of the projected portion 602, a region where the projected portion forms the fixing nip in cooperation with the pressing roller 201 via the fixing belt 130 is called the peak pressure forming region, and the width (B2 in FIG. 4) of the peak pressure forming region with respect to the recording material feeding direction is called the peak pressure forming width.

(Longitudinal Shape of Projected Portion)

The longitudinal shape of the projected portions 601 and 602 as a feature of this embodiment will be described. In this embodiment, the projection amount of the projected portion 602 in the end portion region is smaller than the projection amount of the projected portion 601 in the central region, and the peak pressure forming width of the projected portion 602 is broader than the peak pressure forming width of the projected portion 601.

In a cross-sectional shape cut along a flat plane perpendicular to the longitudinal direction of the guiding member 132, at a downstream end of the fixing nip 101, an angle formed between a surface (horizontal surface in FIGS. 3 and 4) perpendicular to the pressing direction and a surface of the guiding member 132 in a side of the pressing direction is defined as a discharge inclination angle. In this case, compared with the longitudinal central portion, the discharge inclination angle is formed with a small value at the longitudinal end portion.

As shown in FIG. 4, in the end portion region, the projection amount A2 of the projected portion 602 was made smaller than the projection amount (A1 in FIG. 3) in the central region. On the other hand, the top portion of the projected portion 602 was formed in a flat surface shape having a broader width, so that the peak pressure forming width B2 in the fixing nip region was made larger than the peak pressure forming width B1 at the central portion.

Figure 6:
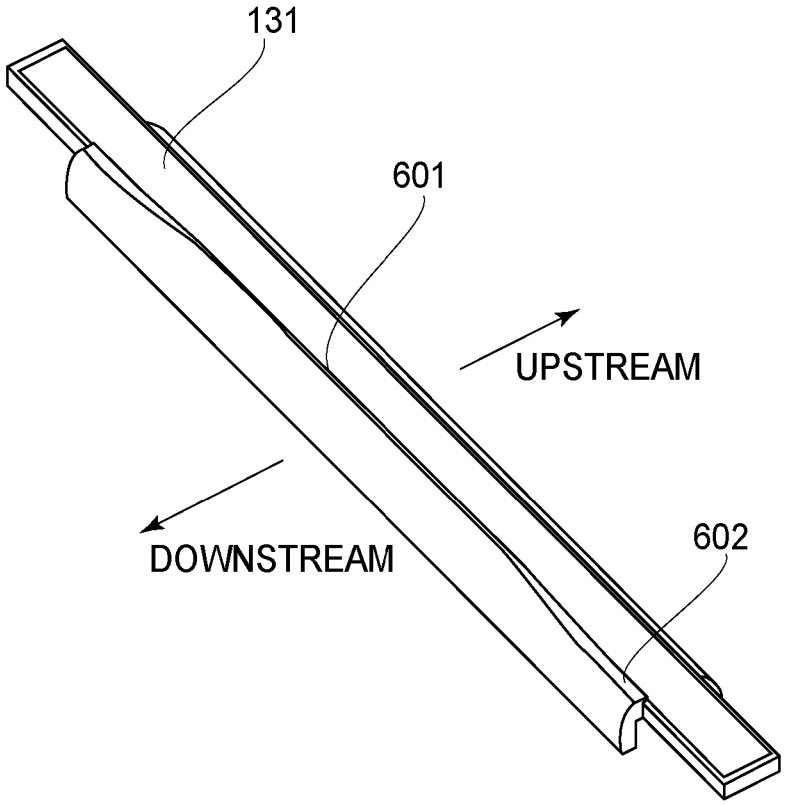
FIG. 6 is a perspective view showing a shape of a supporting member in Embodiment 1.

As a result of the use of the above constitution, the discharged inclination angle (J2 in FIG. 4) in the end portion region is smaller than the discharge inclination angle (J1 in FIG. 3). Correspondingly, the discharging angle (H2 in FIG. 4) in the end portion region of the recording material is smaller than the discharging angle (H1 in FIG. 3) in the central region. FIG. 6 is a perspective view showing a nip forming member supporting member including the projected portions in this embodiment.

Figure 5:
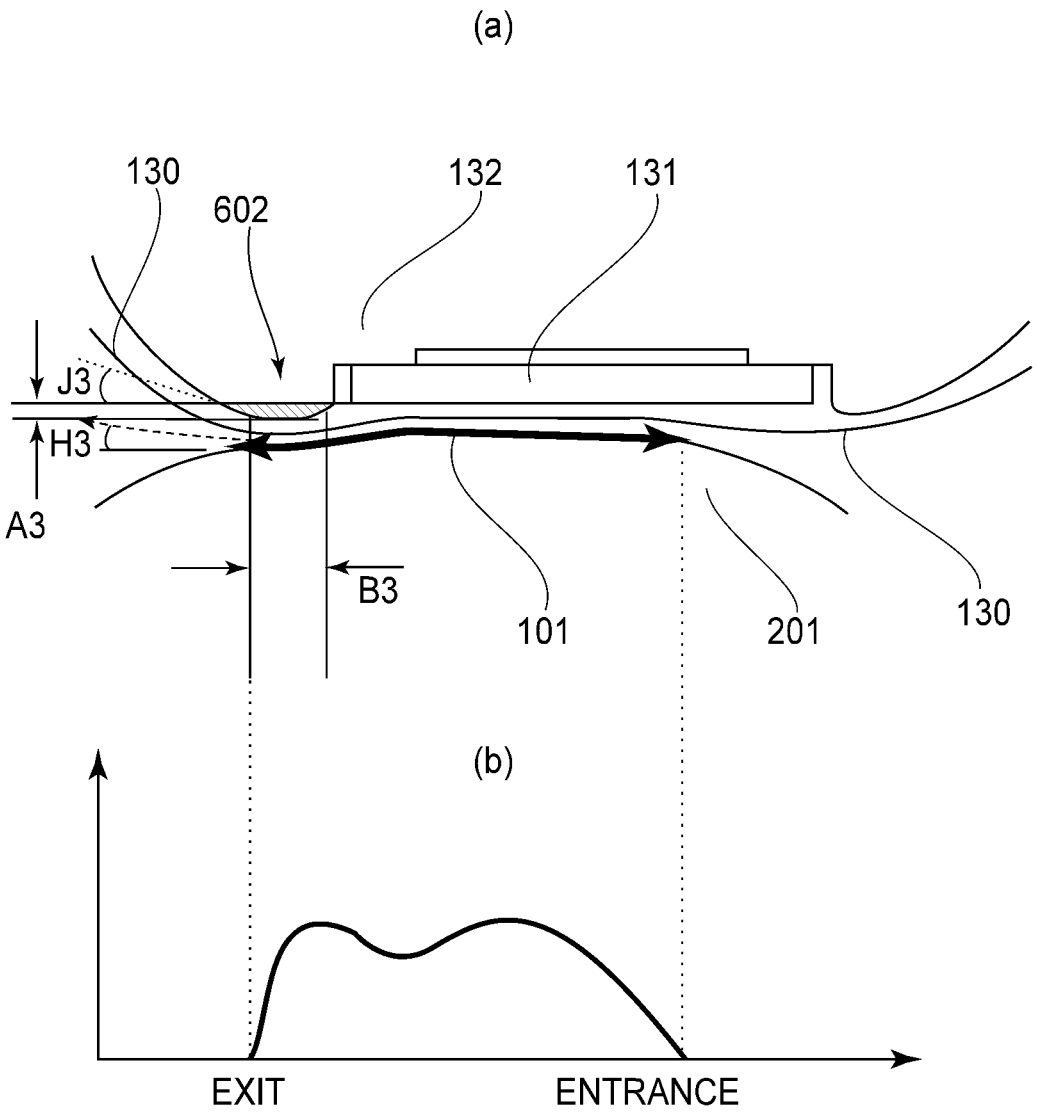
In FIG. 5, (a) and (b) are views each in the neighborhood of the fixing nip in an end portion region of the fixing device in Embodiment 1.

Incidentally, the top portion shape of the projected portions may also be a shape other than the flat surface shapes as shown in FIGS. 3 and 4, and for example, by forming a curved shape having a large radius of curvature as shown in FIG. 5, the peak pressure forming width may also be broadened.

Figure 7:
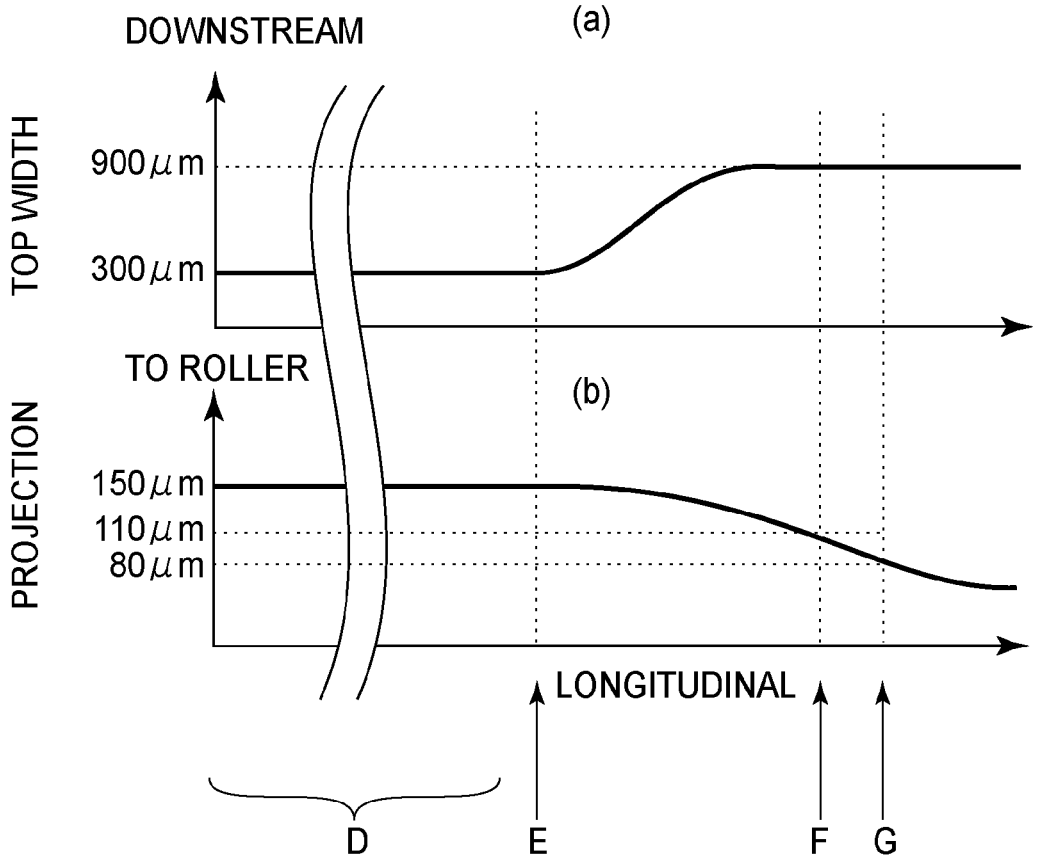
In FIG. 7, (a) and (b) are graphs showing a relationship between a longitudinal position and a peak pressure forming width of a projected portion and a relationship between the longitudinal position and a projection amount of the projected portion, respectively.

With reference to FIG. 7, the longitudinal shape of the projected portions in this embodiment will be described. In FIG. 7, (a) shows the peak pressure forming width (top width) at each of longitudinal positions of the projected portions, and (b) shows the projection amount at each of longitudinal positions of the projected portions.

The longitudinal shape of the projected portions is symmetrical with respect to the longitudinal center (line), and therefore the origin of the abscissa is a longitudinal center position, and the abscissa represents the distance from the center position to the end portion. Further, with respect to the projection amount shown in (b) of FIG. 7, the origin of the ordinate is the heater surface as a reference, and the ordinate represents the amount by which the top of the projected portions projects from the heater surface in the direction approaching the pressing roller 201.

In this embodiment, an upstream end, with respect to the recording material feeding direction, from which the peak pressure forming region starts is the same position independently of the longitudinal position. For this reason, the graph of a change in peak pressure forming width with respect to the longitudinal direction shown in (a) of FIG. 7 coincides with also a longitudinal shape of the peak pressure forming region when the peak pressure forming region is seen from a lower side in FIG. 3 so that the feeding direction extends toward an upper side.

Specific dimensions will be described. In a central region D including the longitudinal center position in FIG. 7, the peak pressure forming width is 300 μm, and the projection amount of the projected portion is 150 μm. These peak pressure forming width and projection amount are set so as to satisfactorily perform fixing and an produce satisfactory image quality. Further, as shown in FIG. 7, with a distance from a position E, of 90 mm from the longitudinal center position, toward the end portion, the projected portion is made gradually small and the peak pressure forming width is made gradually large.

As a result, a position F in FIG. 7 is a position (of 103 mm from the longitudinal center position) of the longitudinal end portion in a maximum image forming region. At the position F, the peak pressure forming width of the projected portion is set at 900 μm and the projection amount of the projected portion is set at 110 μm. Further, a position G in FIG. 7 is a position (of 108 mm from the longitudinal center position) of the longitudinal end portion of a letter-sized recording material, which is a maximum width recording material feedable in the feeding direction in this embodiment. At the position G, the peak pressure forming width of the projected portion is set at 900 μm and the projection amount of the projected portion is set at 80 μm. The projected portions 601 and 602 in this embodiment include, between the positions E and F in FIG. 7, a region where with the distance from the longitudinal center toward the end portion, the projection amount decreases and the peak pressure forming width broadens. When at least a part of this region is positioned within the maximum image forming region, the effect of this embodiment is achieved.

An improving effect of a thin paper separating property and changes in fixing performance and image quality in the case where this embodiment is employed will be described. Table 1 appearing hereinafter shows a result of a comparison between this embodiment and Comparison Examples. In Comparison Example 1, a fixing device using a guiding member in which each of the projection amount and the peak pressure forming width is made the same between the longitudinal central region and the longitudinal end portion region is used. In Comparison Example 2, the projection amount in the end portion region is made smaller than the projection amount in the central region, and the peak pressure forming width is made the same between the end portion region and the central region.

For evaluation of the separation performance, 20 sheets of a recording material of 64 g/m$^2$ on which a solid black image was formed were passed through the fixing device. The recording material that caused improper feeding and the occurrence of jam was evaluated as "x", the recording material that caused no occurrence of a jam, but caused the disorder of feeding after the fixing such that a leading end or a corner of the recording material was folded was evaluated as "Δ", and the recording material that caused no problem was evaluated as "o". Further, also a discharging angle H of the recording material at that time is as shown in Table 1. For evaluation of the fixing performance and the gloss (glossiness), the recording material that caused no problem in terms of both of the properties was evaluated as "o", and other recording materials were evaluated as "x".

TABLE 1

| | PO*1 | PA*2 (μm) | PPW*3 (μm) | DA*4 (deg.) | SP*5 | FP*6 | G*7 |
|---|---|---|---|---|---|---|---|
| EMB. 1 | CP | 150 | 300 | 18 | ○ | ○ | ○ |
| | EP | 80 | 900 | 15 | ○ | ○ | ○ |
| COMP. | CP | 150 | 300 | 25 | Δ | ○ | ○ |
| EX.1 | EP | 150 | 300 | 30 | x | ○ | ○ |
| COMP. | CP | 150 | 300 | 22 | Δ | ○ | ○ |
| EX.2 | EP | 80 | 300 | 20 | Δ | x | x |
| COMP. | CP | 150 | 300 | 21 | Δ | ○ | ○ |
| EX.3 | EP | 150 | 900 | 19 | Δ | ○ | ○ |

*1"PO" is the portion. "CP" is the central portion, and "EP" is the end portion.
*2"PA" is the projection amount.
*3"PPW" is the peak pressing width.
*4"DA" is the discharging angle.
*5"SP" is the separation performance.
*6"FP" is a fixing performance.
*7"G" is the gloss.

Figure 12:
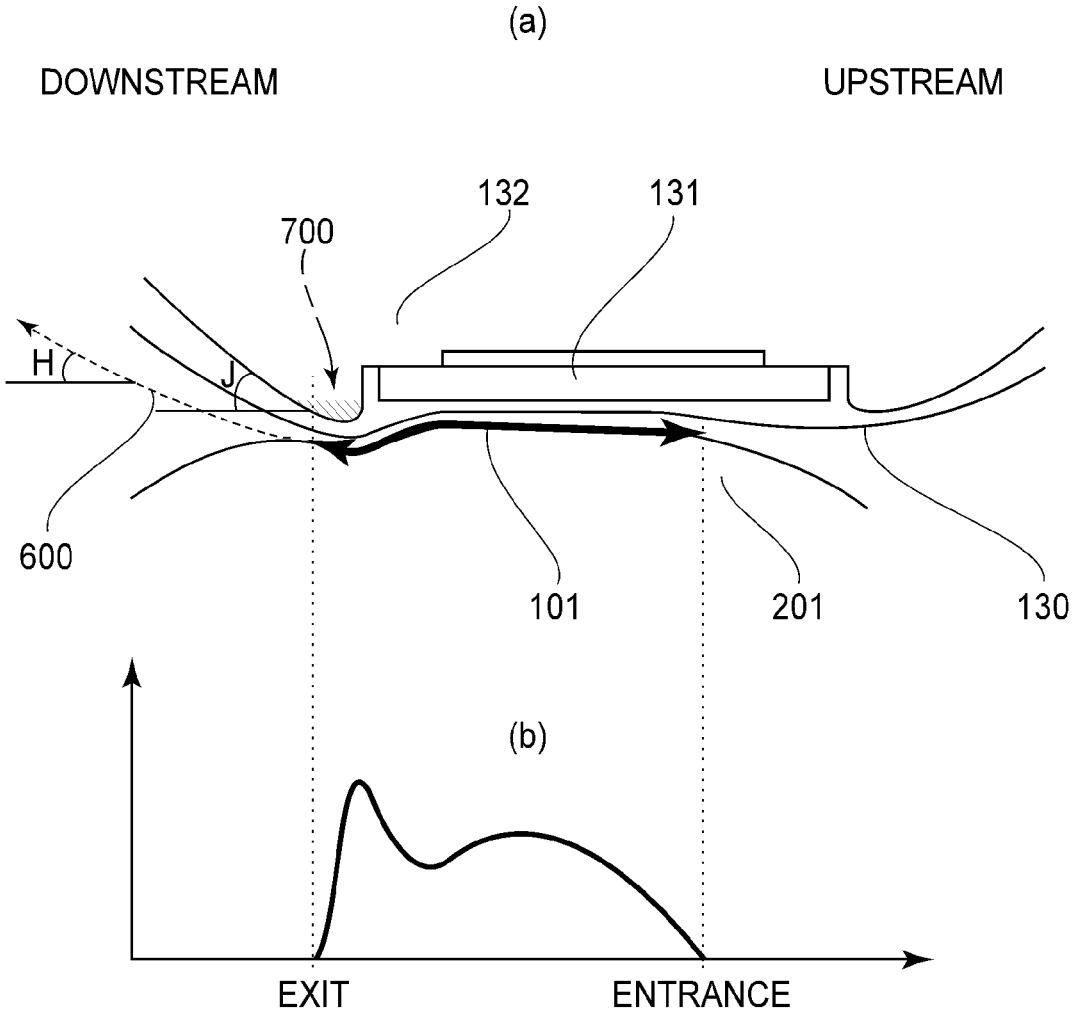
In FIG. 12, (a) is an enlarged sectional view in the neighborhood of the fixing nip in the fixing device according to the conventional example, and (b) is a graph showing a pressure distribution in a region of the fixing nip in the fixing device according to the conventional example.

When the projection amount is large, as shown in (a) of FIG. 12, the projected portion is in a projected state into the pressing roller 201. As a result, at the exit (downstream end with respect to the recording material feeding direction) in the region of the fixing nip 101, the fixing belt 130 is pressed in close contact with a portion where the guiding member 132 is inclined in an upper left direction in (a) of FIG. 2. As a result, both of a locus of the fixing belt 130 and a recording material pressing direction follow the same inclination direction, so that the discharging angle H of the recording material becomes large and thus the separation performance decreases.

On the other hand, in this embodiment, by making the projection amount of the projected portion in the end portion region smaller than that in the central region, the projection of the projected portion into the pressing roller 201 is suppressed and thus the lowering of separation performance is suppressed. That is, in this embodiment, as shown in FIG. 4, a free end of the projected portion is formed in a shape close to the flat surface at the exit of the fixing nip, so that the peak pressure forming width is broadened.

On the other hand, in the case where the projection amount of the projected portion is made small to the extent that there is no influence on such a separation performance, a lowering in fixing performance and glossiness occurs, and thus the image quality decreases in some cases. Therefore, the peak pressure forming width of the projected portion is enlarged in the end portion region, so that the peak pressure application time is extended, and thus the lowering in fixing performance and glossiness is suppressed.

According to the result of Table 1, compared with Comparison Example 1, it was confirmed that the projection amount of the recording material was decreased, and thus the separation performance was improved in this embodiment. Further, it also turned out that there was also no problem with respect to the fixing performance and the glossiness. The discharging angle H of the recording material particularly decreases at the longitudinal end portion where the shape of the projected portion is changed, but is improved with respect to also the longitudinal central portion. This may be attributable to a lowering in discharging angle of the entire recording material including the longitudinal central portion and including the longitudinal end portion as a trigger.

The reason why the discharging angle H of the recording material at the longitudinal end portion would be considered is as follows. That is, it would be considered that the discharging angle H of the recording material is largely affected by the angle at the position immediately in front of the exit in the fixing nip region. In this embodiment, as shown in FIG. 4, in order to broaden the peak pressure forming width as in the peak pressure forming region B2 immediately in front of the exit in the fixing nip region, the free end of the projected portion is formed in the shape close to the flat surface. For that reason, in the case where the downstream end, with respect to the recording material feeding direction, of the fixing nip region is positioned at such a flat surface portion (horizontal portion), a discharge inclination angle J follows the shape and becomes horizontal, so that also the discharging angle H of the recording material becomes small so as to approach a horizontal state.

In Table 1, the reason why the discharging angle H of the recording material is smaller than that in Comparison Example 2 (in which only the projection amount in the longitudinal end portion is lowered and the peak pressure forming width is the same as that at the longitudinal central portion) is attributable to the shape of the free end of the projected portion made close to the flat surface in order to broaden the peak pressure forming width.

Also, in the case where the downstream end of the fixing nip region with respect to the fixing nip region is positioned downstream of the above-described flat surface portion (horizontal portion), when the discharge inclination angle at the longitudinal end portion is smaller than the discharge inclination angle at the longitudinal central portion, the discharging angle H of the recording material can be similarly made small.

Further, this embodiment employs such a technical concept that the decrease in the fixing property in the end portion region where the projected portion is decreased is made up for through enlargement of the peak pressure forming width. That is, when only the projection amount of the projected portion is simply decreased in the end portion region, the peak pressure at the projected portion in the fixing nip region decreases, so that the fixing performance decreases. In this embodiment, the peak pressure forming width of the projected portion is enlarged in the end portion region, so that the peak pressure application time is extended, and thus the lowering in fixing performance and image glossiness is suppressed.

According to this embodiment, it is possible to ensure sufficient fixing performance and image glossiness at a portion extending to the position F which is the end portion of the maximum image forming region shown in FIG. 7.

Here, as Comparison Example 3, the case where the peak pressure forming width of the projected portion is made broader in the end portion region than in the central region and the projection amount is made the same between the central region and the end portion region is considered. In this case, the projection amount of the projected portion is large, and therefore the projected portion projects into the pressing roller, so that the discharge inclination angle becomes large. Accordingly, the problem of the separation performance of the recording material such as thin paper from the fixing belt cannot be solved.

As described above, according to this embodiment, at the position not only at a downstream side of the guiding member 132 as the nip forming member (supporting member) with respect to the recording material feeding direction, but also within the fixing nip region, the projected portions formed so as to project toward the pressing roller 201 as the pressing member are provided over the longitudinal direction. Further, the projection amount of the projected portion and the width (with respect to the recording material feeding direction) of the contact region of the projected portions with the rotating fixing belt are changed with respect to the longitudinal direction (perpendicular to the recording material feeding direction). Specifically, at the longitudinal end portion, not only the projection amount of the projected portion is made small compared with the longitudinal central portion, but also the width (with respect to the recording material feeding direction) of the contact region of the projected portions with the fixing belt is made broad compared with the longitudinal central portion.

In addition, in the cross-sectional shape cut along the plat plane (surface) perpendicular to the longitudinal direction of the guiding member 132, at the downstream end of the fixing nip region, the discharging angle, which is the angle formed between the surface (horizontal surface in the figure) perpendicular to the pressing direction and the surface of the guiding member 132 in the side of the pressing direction, is set as follows. That is, at the longitudinal end portion, the discharge inclination angle is made smaller than that at the longitudinal central portion. As a result, at the longitudinal end portion, the discharging angle H of the recording material decreases and the guiding member 132 is spaced away from the fixing belt 130, and therefore the separation performance was improved. Further, also at the longitudinal central portion, the influence of the longitudinal end portion is exerted, so that the discharging angle H of the recording material decreased, and thus the separation performance was improved.

On the other hand, the influences on the fixing performance and the glossiness were able to be suppressed within a tolerance range as described above. Further, such a change was made at the longitudinal end portion including a non-image forming region, and therefore it was possible to prevent the influences on the image fixing performance and the image quality. That is, in this embodiment, it was possible to prevent flexure of the recording material, toward the fixing belt and to improve the separation performance. Further, it was possible to compatibly realize satisfactory separation performance and fixing performance.

Incidentally, the projection amounts of the projected portions, the peak pressure forming widths corresponding to the widths of the projected portions and the longitudinal dimensions of the projected portions, which are shown as numerical values, are mere examples, and therefore do not limit the present invention, and are arbitrarily settable depending on dimensions and physical properties of respective constituent elements.

Embodiment 2

Figure 9:
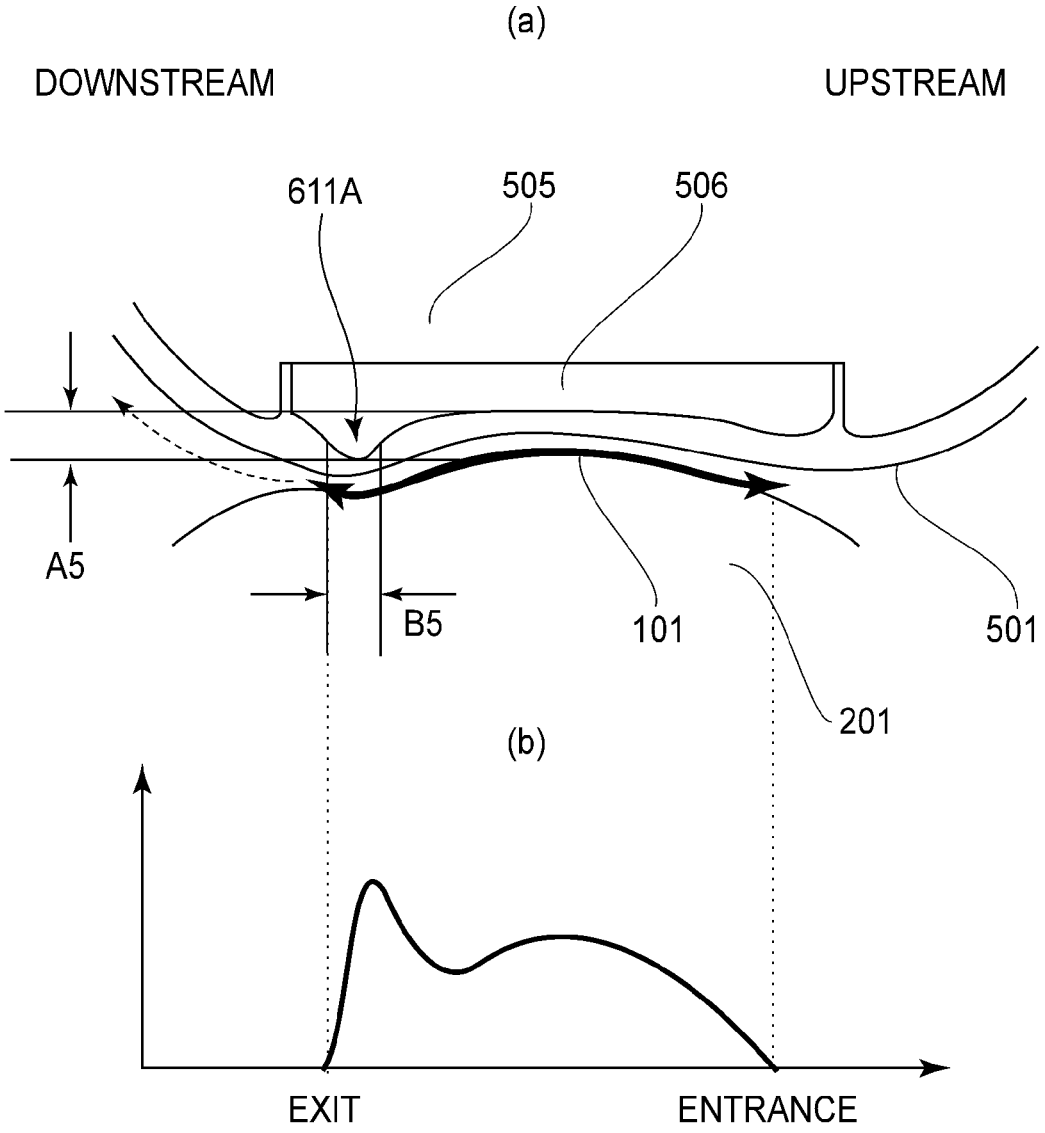
In FIG. 9, (a) and (b) are views each in the neighborhood of a fixing nip in a central region of a fixing device according to Embodiment 3.
Figure 10:
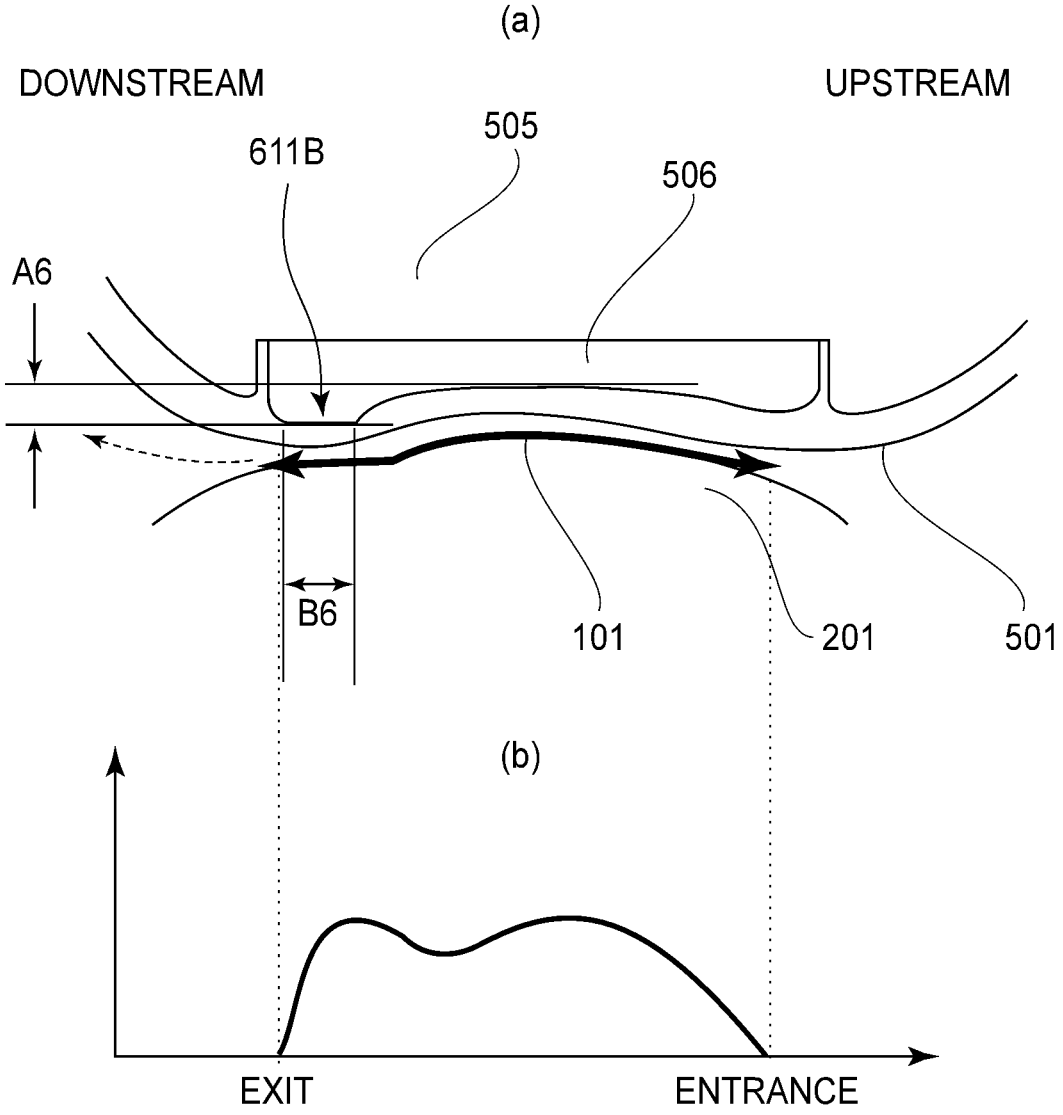
In FIG. 10, (a) and (b) are views each in the neighborhood of the fixing nip in an end portion region of the fixing device according to Embodiment 3.

Embodiment 2 differs from Embodiment 1, and in this embodiment, projected portions 611A and 611B are not provided on a guiding member 505, but are provided on a sliding member 506 in a downstream side with respect to a recording material feeding direction. In this constitution, similarly as in Embodiment 1, at the longitudinal end portion region, the projection amount of the projected portion 611B is decreased and the peak pressure forming width is broadened (FIGS. 9 and 10). Further, in this embodiment, a nip forming member (supporting member) at a central portion of the fixing nip 101 with respect to the recording material feeding direction does not have a flat surface shape (heater) as in Embodiment 1 but has a curved shape (sliding member 506).

Figure 8:
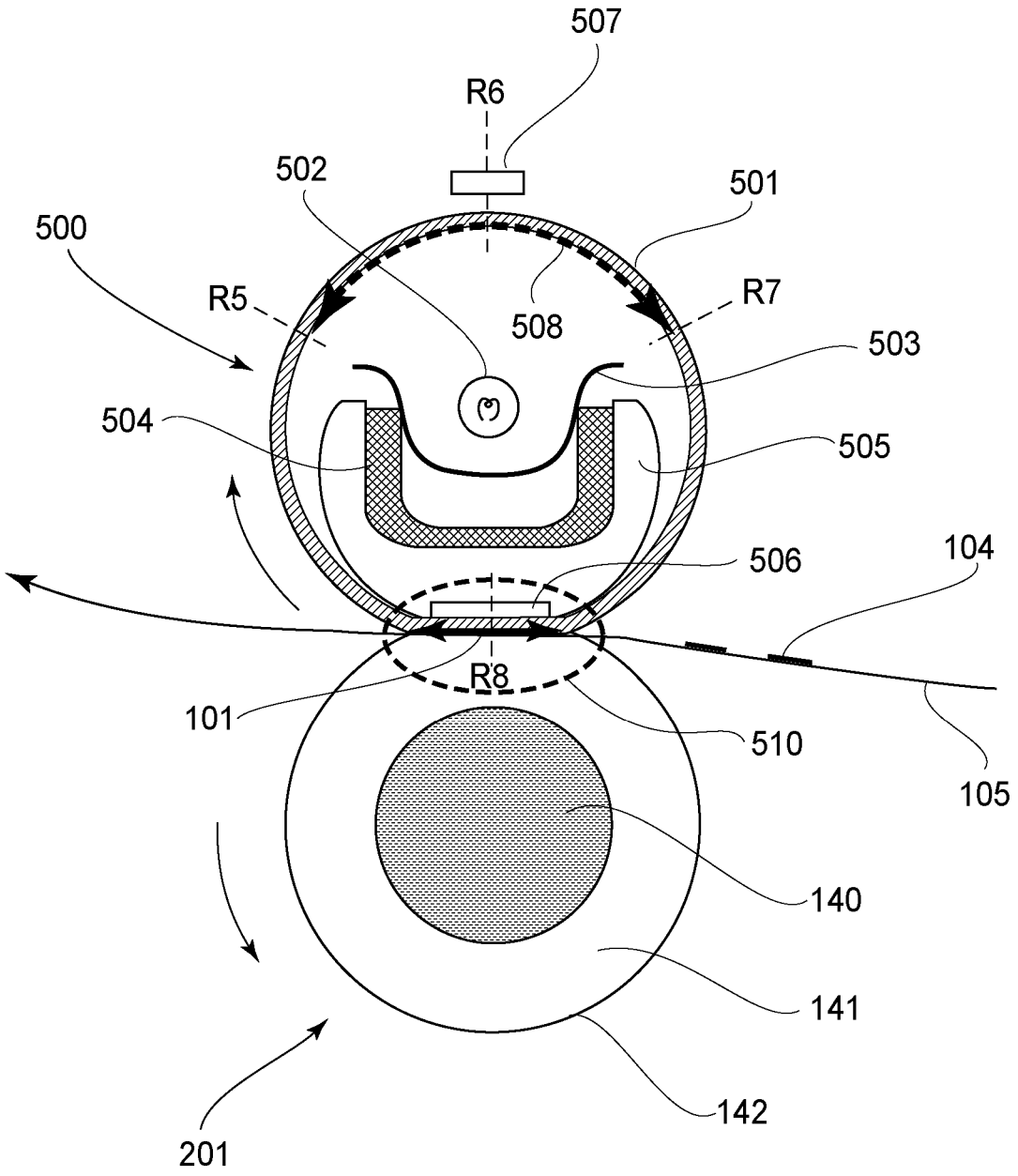
FIG. 8 is a schematic view showing a cross-section of a fixing device according to Embodiment 2.

Further, as shown in FIG. 8*m* a heating unit 500 has such a structure that a halogen lamp heater 502 as a heating mechanism is provided inside a fixing belt 501 in non-contact with the fixing belt 501. The fixing belt 501 is heated by absorbing, at an inner surface thereof, radiant light emitted from the halogen lamp heater 502. In FIG. 8, an aluminum-made reflection plate 503 is used for reflecting the radiant light, emitted in a downward direction in FIG. 8, toward the fixing belt 501.

The fixing belt 501 has the same layer structure as that in Embodiment 1, and was enlarged in outer diameter to 30 mm so that the halogen lamp heater 502 and the reflection plate 503 were accommodated inside the fixing belt 501. In order to efficiently absorb the radiant light from the halogen lamp heater 502, the color of the inner surface of the fixing belt 501 may desirably be black.

By employing the above-described constitution, a region (of about 31 mm in width), which is ⅓ of an outer peripheral length of the fixing belt 501, ranging from R5 to R7 on a rotation locus of the fixing belt 501 is a heating region through which heat is supplied from the halogen heater 502 to the fixing belt 501.

In this embodiment, the sliding member 506 is provided for not only forming a stable fixing nip by receiving a pressure, but also stably rotating the fixing belt 501 while reducing the degree of sliding friction with the fixing belt 501. Specifically, the sliding member 506 was formed of alumina in a thickness of 0.8 mm, and at a sliding surface with the fixing belt 501, a 10 μm-thick smooth glass layer was formed.

Similarly as in Embodiment 1, between the fixing belt 501 and the sliding member 506, in order to reduce the degree of friction, heat-resistant grease is interposed. The heating unit 500 further includes a metal framework 504, a holder member 505 fixing the sliding member 506, and a non-contact type thermistor 507 for detecting a surface temperature of the fixing belt 501.

In the fixing device of this embodiment, the pressing roller 201 is driven and rotated by an unshown driving motor so that a surface speed thereof is 200 mm/sec, and the fixing belt 501 is rotated by the pressing roller 201.

In this embodiment, the sliding member 506 employed as the nip forming member for pressing the pressing roller 201 via the fixing belt 501 is not required to be provided with a member, having a heating function, such as the heater. For that reason, as the nip forming member, a member which is easily processed and molded can be used, so that the nip forming member can have a freer shape. In this embodiment, the shape of the sliding member 506, as the nip forming member, for press-contacting (supporting) the fixing belt was a curved shape as shown in FIGS. 9 and 10. FIGS. 9 and 10 are enlarged sectional views each showing a portion in the neighborhood of the fixing nip enclosed by an elliptical broken line 510 in FIG. 8, in which FIG. 9 shows the longitudinal central portion, and FIG. 10 shows the longitudinal end portion.

In this embodiment, only the sliding member 506 constitutes the nip forming member (supporting member) for press-contacting (supporting) the fixing belt from the rear side. In the central region (with respect to the recording material feeding direction) of the fixing nip, the sliding member 506 has a curved shape which follows curvature of the pressing roller 201 and which is curved upward in FIGS. 9 and 10, so that a close contact property with the pressing roller 201 is enhanced. As a result, a broader fixing nip region (with respect to the recording material feeding direction) is ensured. In a downstream side of the sliding member 506 with respect to the recording material feeding direction, the projected portion (611A in FIG. 9, 611B in FIG. 10) projecting toward the pressing roller 201 is provided, so that similarly as in Embodiment 1, improvements in fixing performance and image quality by imparting glossiness to the image was realized.

In this embodiment, the projection amount of the projected portion was defined as follows. That is, the projection amount is the amount by which the projected portion is projected, relative to the surface of the sliding member 506 at the central portion of the fixing nip 101 with respect to the recording material feeding direction, in the pressing direction, which is the downward direction in FIGS. 9 and 10. In FIGS. 9 and 10, amounts A5 and A6 are the projection amounts, respectively.

Further, a region (with respect to the recording material feeding direction) where the projected portions press the pressing roller 201 via the fixing belt 501 is referred to as the peak pressure forming region similarly as in Embodiment 1. In FIGS. 9 and 10, amounts B5 and B6 are the peak pressure forming regions, respectively.

Also in this embodiment, similarly as in Embodiment 1, at the longitudinal end portion, in order to decrease the discharging angle H of the recording material, as shown in FIG. 10, the projected portion was made small compared with that at the longitudinal central portion and was made broad compared with that at the longitudinal central portion.

By employing the above-described constitution, also in the fixing device as in this embodiment, similarly as in Embodiment 1, it is possible to compatibly realize the improvements in fixing performance and image quality and the improvement in recording material separation performance.

In this embodiment, the constitution in which the sliding member having the curved shape is used as the nip forming member is described, but the sliding member may also have a flat surface shape similarly as in Embodiment 1. Further, the holder member (corresponding to the guiding member 132) for holding the sliding member having the flat surface shape may also be provided with the projected portions for pressing the pressing roller via the fixing belt. Further, the projected portions are formed in a longitudinal shape similarly as in Embodiment 1, so that a similar effect can be obtained.

Modified Embodiment 1

In the above-described embodiments, the fixing belt was heated by the heater or the halogen lamp as the heating source, but the present invention is not limited thereto. That is, the fixing belt may also be heated by magnetic flux from an exciting coil as a magnetic flux generating source or by a current from a power source.

Modified Embodiment 2

In the above-described embodiments, as an opposing member, opposing the fixing belt (first rotatable member), for forming the fixing nip in cooperation with the fixing belt, the pressing roller (second rotatable member) was described, but the opposing member may also be a belt (second rotatable member) stretched and rotated around a plurality of pulleys. Further, the opposing member may also be fixed pad-like member (pressing pad).

While the invention has been described with reference to the structures disclosed herein, it is not confined to the details set forth and this application is intended to cover such modifications or changes as may come within the purpose of the improvements or the scope of the following claims.

This application claims the benefit of Japanese Patent Application No. 2014-152891 filed on Jul. 28, 2014, which is hereby incorporated by reference herein in its entirety.

What is claimed is:

1. A fixing device for fixing an image on a recording material, comprising:

a cylindrical film;

a nip forming member contacting an inner surface of said film; and a back-up member configured to form a nip in cooperation with said nip forming member via said film, the nip being a contact region where said film and said back-up member contact each other to feed the recording material and being a portion extending from an entrance where the recording material in an unnipped state enters the contact region to an exit where the recording material comes out of the contact region, wherein said nip forming member includes a projected portion, at the exit, projected toward said back-up member, wherein at least a part of said projected portion with respect to a recording material feeding direction is inside the nip and contacts the inner surface of said film, wherein the projection amount of said projected portion is smaller in an end portion region positioned at an end portion of said projected portion with respect to a generatrix direction of said film than in a central region positioned at a central portion of said projected portion with respect to the generatrix direction, at least a part of the end portion region being inside a feeding region of a maximum-sized recording material usable in said fixing device, and wherein with respect to the recording material feeding direction, the width of the part of said projected portion inside the nip is broader in the end portion region than in the central region.

2. A fixing device according to claim 1, wherein at least the part of the end portion region is inside a maximum image region formed on the recording material.

3. A fixing device according to claim 1, wherein said projected portion has a region in which the projection amount gradually decreases from the central portion toward the end portion with respect to the generatrix direction and in which the width of the part of said projected portion inside the nip gradually broadens from the central portion toward the end portion.

4. A fixing device according to claim 1, wherein the nip has a flat region in an entrance side with respect to the recording material feeding direction in the nip, and wherein said projected portion projects from the flat region toward said back-up member.

5. A fixing device according to claim 1, wherein said nip forming member includes a heater and a supporting member configured to support the heater, and wherein said projected portion is formed on the supporting member.

6. A fixing device for fixing an image on a recording material, comprising:

a cylindrical film;

a nip forming member contacting an inner surface of said film; and a back-up member configured to form a nip in cooperation with said nip forming member via said film, the nip being a contact region where said film and said back-up member contact each other to feed the recording material and being a portion extending from an entrance where the recording material in an unnipped state enters the contact region to an exit where the recording material comes out of the contact region, wherein said nip forming member includes a projected portion, at the exit, projected toward said back-up member and at least a part of said projected portion with respect to a recording material feeding direction is inside the nip and contacts the inner surface of said film, and a feeding region of a maximum-sized recording material usable in said fixing device, wherein said projected portion has a region in which the projection amount gradually decreases from the central portion toward the end portion with respect to the generatrix direction and in which the width of the part of said projected portion inside the nip gradually broadens from the central portion toward with respect to the recording material feeding direction.

7. A fixing device according to claim 6, wherein at least a part of the region is inside a maximum image formed on the recording material.

8. A fixing device according to claim 6, wherein said nip forming member includes a heater and a supporting member configured to support the heater, and wherein said projected portion is formed on the supporting member.

* * * * *